United States Patent [19]

Segal

[11] Patent Number: 4,804,091

[45] Date of Patent: Feb. 14, 1989

[54] PACKAGING FOR HAND-HELD PRODUCT

[75] Inventor: William J. Segal, Torrance, Calif.

[73] Assignee: Mr. Gasket Company, Cleveland, Ohio

[21] Appl. No.: 176,215

[22] Filed: Mar. 31, 1988

[51] Int. Cl.[4] ..... B65D 73/00

[52] U.S. Cl. ..... 206/457; 206/459; 206/463

[58] Field of Search ..... 206/463, 457, 459

[56] References Cited

U.S. PATENT DOCUMENTS

| | | | |
|---|---|---|---|
| 2,032,807 | 3/1936 | Masbach | 206/457 X |
| 3,173,540 | 3/1965 | Liapides | 206/463 |
| 4,101,032 | 7/1978 | Obidniak | 206/457 |

*Primary Examiner*—William Price

*Attorney, Agent, or Firm*—Body, Vickers & Daniels

[57] ABSTRACT

A self sustaining package for encapsulating and displaying a hand-held consumer product, which product includes an upper housing containing a manually manipulative implement, such as a spot light, and a generally elongated handled fixed to the housing and extending downwardly therefrom, the package includes a clear plastic front display sheet with a generally flat surface lying on the central plane of the product, a first forwardly protruding cavity permanently formed into the display sheet with an outer shape matching the protruding portion of the housing on the product and the second forwardly protruding cavity permanently formed into a selected shape in the display sheet with the form generally matching the handle portion of the product. The selected shape of the second cavity includes a set of undulating ribs extending transversely across the girth portion of the handle as simulated fingers gripping the girth portion of the handle and a transversely extending hollow portion extending into a simulated hand and part of a simulated wrist extending transversely from said girth portion so that the product is visible through the package while the simulated hand appears to be gripping the handle portion of the packaged product.

13 Claims, 4 Drawing Sheets

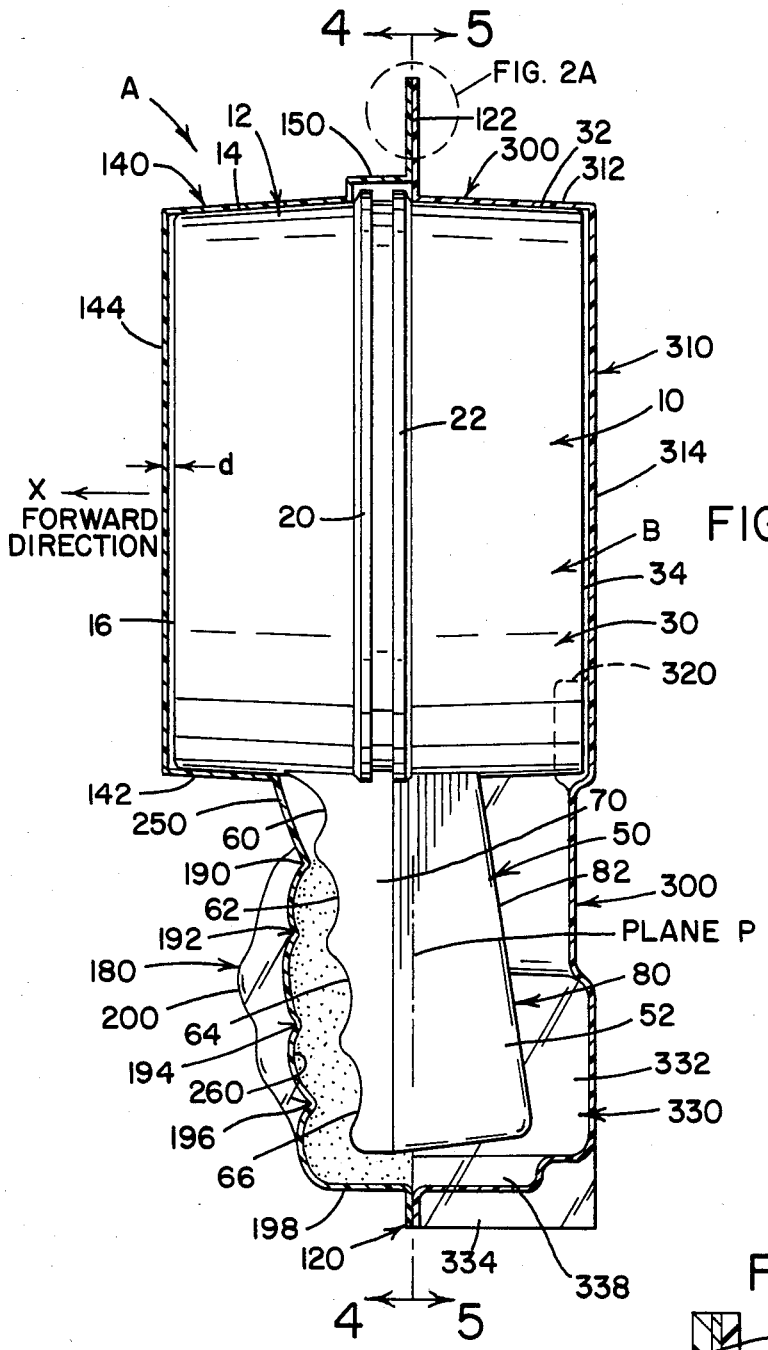
FIG. 2
FIG. 2A
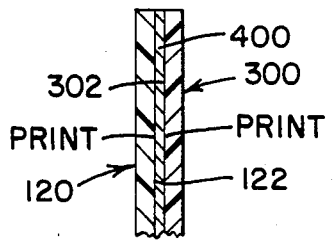

PACKAGING FOR HAND-HELD PRODUCT

The present invention relates to the art of packages for consumer products and more particularly to a package for a hand-held consumer product.

The invention is particularly applicable for encapsulating and displaying a hand-held consumer product, such as a spot light of the type having a cord which is connected to the cigarette lighter socket on an automobile, and it will be described with particular reference thereto; however, it is appreciated that the invention has much broader applications and may be employed for encapsulating and displaying a wide variety of hand-held consumer products, such as electric power tools, meters and other products of the type that are mass produced and sold in packages in retail outlets where the consumer recognizes and selects the product primarily by the package in which it is displayed.

A tremendous amount of money and effort have been devoted to development of packages for encapsulating and displaying consumer products for sale in mass merchandising retail outlets. These packages are now becoming products in themselves from the standpoint that they have several mechanical functions relating to their overall objective of protecting the product, informing the consumer of the product's characteristics, displaying the product in a fashion encouraging purchasing and advising the perspective customer of the overall characteristics of the product. Most of these functions have heretofore been performed by utilizing boxes in which the product is shipped and sold. A wide variety of information, such as photographs, art work and graphic description, can be provided on the box to accomplish the objective of selling the product to the consumer; however, boxes have serious deficiencies in the overall plan of mass merchandising relatively low cost consumer products. Boxes are expensive and require substantial labor and shipping volumes. A consumer does not fully appreciate the details of the product housed in a box. The picture on the box can actually mislead the consumer. For that reason, the boxes are opened to inspect the contents. Unless done with care, such tampering can cause damage to the product and loss of associated accessories and various informational data contained within the box. Consequently, packaging of consumer products is quite prevalent and has developed into a mechanical art. Such packaging includes clear plastic sheets in which the product is housed so that the product itself is visible to the perspective consumer as well as various art work inside the package. In the past, such packages included only an intermediate informational sheet visible from the front and back together with cavities for housing the product to be displayed and sold. These packages often included a front clear plastic sheet with the cavity or cavities accommodating the front portion of a product and a back sheet which is normally flat. The back sheet included printed material on which the product is laid and covered by a front display sheet having permanent cavities matching the product. This type of packaging has tremendous commercial advantages over boxes; however, it does not allow for a substantial amount of information regarding use being displayed and available to the consuming public at the point of purchase. Any modification of this packaging to provide additional information without interrupting the advantages of packaging is an objective of the companies using these packages for mass merchandising various products.

THE PRESENT INVENTION

The present invention is an improvement in a self sustaining package of the type described above for encapsulating and displaying a hand-held consumer product. The product, such as a spot light, includes an upper housing with a front portion, such as the lens portion of the spot light, facing in a forward direction and a rearwardly facing back portion, together with a rigid downwardly depending, generally elongated handle fixed to the upper housing and extending in a direction generally orthogonal with respect to the forward direction in which the housing faces. This type of hand-held product has, for the purpose of orienting the description of the package, a generally vertical plane extending in the direction of the handle and generally parallel between the front and back faces of the product. In accordance with the invention, a clear plastic front display sheet is provided with a generally flat interface surface lying generally on the aforementioned plane of the product. This display sheet has a first forwardly protruding cavity permanently formed in the plastic display sheet with an outer peripheral shape generally matching the outer shape of the housing and the profile generally matching the outer profile of the housing and a second forwardly protruding cavity permanently formed into a selected shape in the same display sheet, with a form generally matching, but larger than, the protruding girth portion of the handle. This selected shape of the second cavity is in the form of a human hand including a set of undulating ribs extending transversely across the girth portion of the handle to simulate fingers gripping the girth of the handle and a transversely extending hollow portion formed into a simulated hand and part of a simulated wrist extending transversely from the girth portion of the product handle. This second cavity is unique in that it does not match the product extending outwardly into the area of the front display sheet. This cavity is larger to simulate a hand formed from a series of transverse ribs intersecting a hollow hand portion and a tapered hollow simulated wrist portion. A back cover sheet is joined to the interface surface of the front display sheet to encapsulate the hand-held product, with the housing in the first cavity and the handle in the second cavity. By this structure, the display sheet can convey, rapidly and without mental manipulation, the concept that the product being sold in the unique novel package is a hand-held product. This rapid recognition of the product use is advantageous to mass marketing of hand-held products.

In accordance with another aspect of the present invention, the inner surface of the second cavity is provided with a color layer, such as a layer of paint, which layer simulates the color of the human hand to provide a still more realistic visual display to the consuming public of the fact that the product encapsulated and displayed in the inventive package is, indeed, a hand-held consumer product.

In accordance with another aspect of the present invention, an information sheet is located between the clear plastic display sheet and the back cover sheet with printed material visible through the display sheet in areas except in the areas of the cavities previously mentioned. In addition, informational data can be printed on both sides of the informational sheet to be visible through the clear plastic sheet forming the back cover sheet.

In accordance with another aspect of the present invention, the back cover sheet is provided with an interface surface adapted to lie flat against the interface surface of the display sheet and includes first and second cavities generally matching the first and second cavities of the display sheet so that the consumer product can be fully encapsulated while the housing and handle protrude toward the back side of the package. The second cavity on the back sheet matches only a portion of the second cavity on the front display sheet since a simulated hand is not necessary at the back of the package. This back cavity can be enlarged to contain the cord of the packaged product.

The primary object of the present invention is the provision of a self sustaining package for encapsulating and displaying a hand-held consumer product, which package incorporates an outwardly protruding cavity adjacent the handle of the product which cavity has a shape generally simulating a human hand for visually displaying to the consuming public the product in the package as a hand-held product.

Yet another object of the present invention is the provision of a self-sustaining package, of the type described above, which package is no more expensive than similar packages, but still conveys, without the printed material, that the product being sold is a hand-held product.

These and other objects and advantages will become apparent from the following description taken together with the accompanying drawings.

BRIEF DESCRIPTION OF DRAWINGS

FIG. 2 is a cross sectional view taken generally along line 2—2 of FIG. 1;

FIG. 2A is an enlarged, schematic cross-sectional view taken in the general area of the circle shown in FIG. 2 for the purpose of illustrating the intermediate informational sheet;

PREFERRED EMBODIMENT

Figure 5:
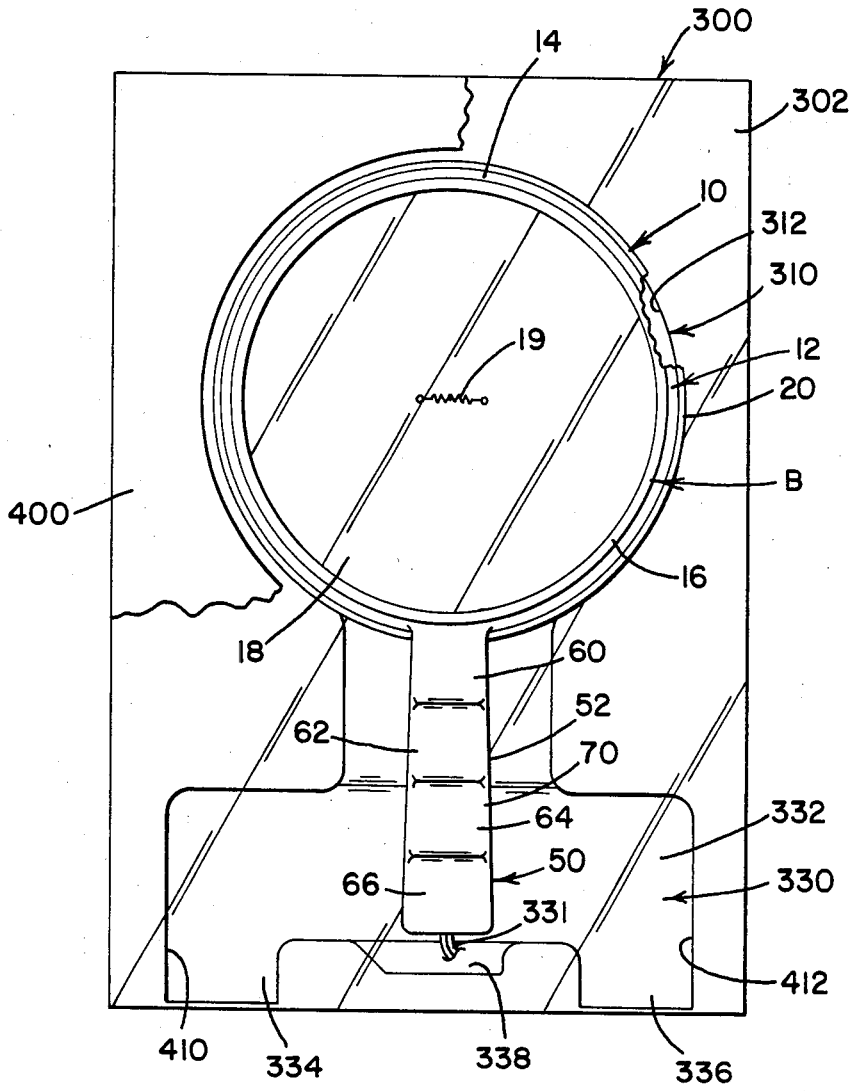

Referring now to the drawings wherein the showings are for the purpose of illustrating the preferred embodiment of the invention only, and not for the purpose of limiting same, the figures show a package A for encapsulating and displaying a hand-held product B in the form of a spot light. Before explaining the package, certain characteristics of the consumer product to be sold in the package will be explained for the purposes of orienting the various mechanical components of the package. These components of the product are generally common in some form or another in hand-held products, such as spot lights, meters, and power tools. Such products include a housing 10 with a forward portion 12 facing in direction X and having a maximum outer periphery 14 and a forwardly facing profile 16. In this example of a spot light, the outer profile is flat and the periphery 14 is circular; however, the product could have other peripheral shapes and outwardly facing profiles. For instance, a power tool may be mounted to display, as the forward portion of the product, a first side of the power tool. The illustrated product, which is a spot light, includes outwardly facing lens 18, a central filament 19, best shown in FIG. 5, and outwardly facing annular support ribs 20, 22 for allowing the housing to be disassembled in a manner not here relevant. A rear portion 30 of housing 10 includes a periphery 22 and a rearwardly facing profile 34 which, in the illustrated product, are circular and flat, respectively. An orthogonally extending handle 50 includes a girth portion 52 having forwardly facing finger slots 60–66 on a slanted front portion 70 of handle 50. This front portion extends forwardly from a central plane P extending through handle 50 as illustrated in FIG. 2 to intersect the product at a position parallel between profiles 16, 34 of housing 10. This plane P is generally at the center line of the package A and is employed for the purpose of defining some of the geometry associated with the package constructed in accordance with the preferred embodiment of the present invention. Of course, the plane could be moved toward the front or back, however; it is at the center section defining the interface of the sheets forming package A. The back palm portion 80 of handle 50 protrudes rearwardly from plane P and is generally parallel to the front portion 70, as is indicated in FIG. 2.

Figure 4:
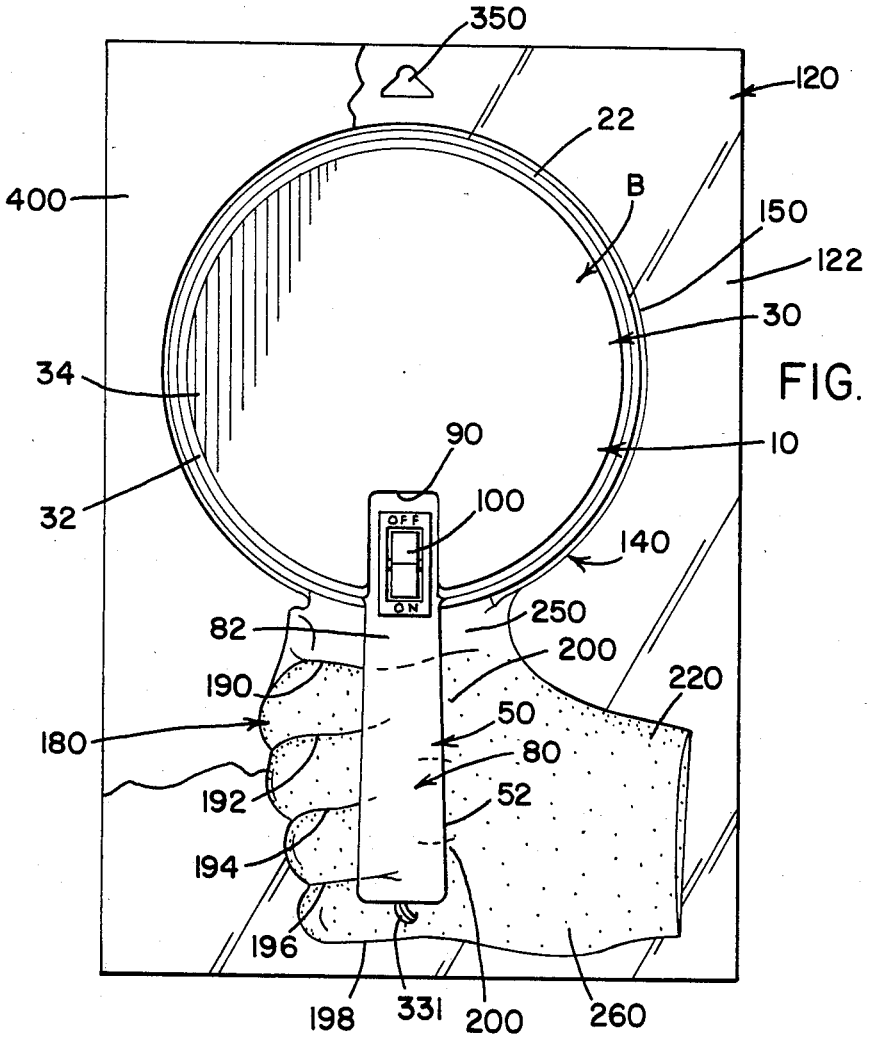
FIG. 4 is a back plan view of the front display sheet taken generally along line 4—4 of FIG. 2 and including the hand-held product; and, FIG. 5 is a plan view of the back cover sheet taken generally along line 5—5 of FIG. 2 showing the product in its displayed position in the package.

Referring now to FIG. 4, the back portion of housing 10 includes an inwardly extending recess 90 for providing thumb access to switch 100, which is mounted generally on the back surface 82 of the palm portion 80 on handle 50.

Having thus defined the parameters of a hand-held product to which the present invention is directed in a manner oriented with respect to the selected center plane P, the details of the package A are clearly illustrated in the drawings. An outer, clear plastic rigid front display sheet 120 has a flat interface surface 122 into which is permanently molded a first cavity 140 for receiving the forward portion of housing 10. This rigid, formed cavity has an outer, generally tapered peripheral wall 142 passing over the periphery 16 of forward portion 12 of housing 10. An outer profile 144 generally matches the outer profile 16 of housing 10 and is spaced from the product a distance b as shown in FIG. 2. As can be seen, the peripheral wall generally receives the product in a snug fashion to align sheet 120 over the front of housing 10. The distance d is a clearance distance so that as the sheet 120 is placed over the front of housing 10, there is a slight amount of play at this location, the product B is held secure on the sheet. First cavity 140 defined by peripheral wall 142 and outer profile 144 is clear so that product B itself may be viewed from the front, or forward, direction X. Of course, this clear plastic cavity could have limited printed information thereon for purposes of advertising, without affecting the ability to see the product B through cavity portion 140 of sheet 120. In accordance with this invention housing B is seen from the front of package A. For this particular product, an annular chamber 150 extends around wall 142 for the purpose of clearing ribs 120, 122.

Figure 1:
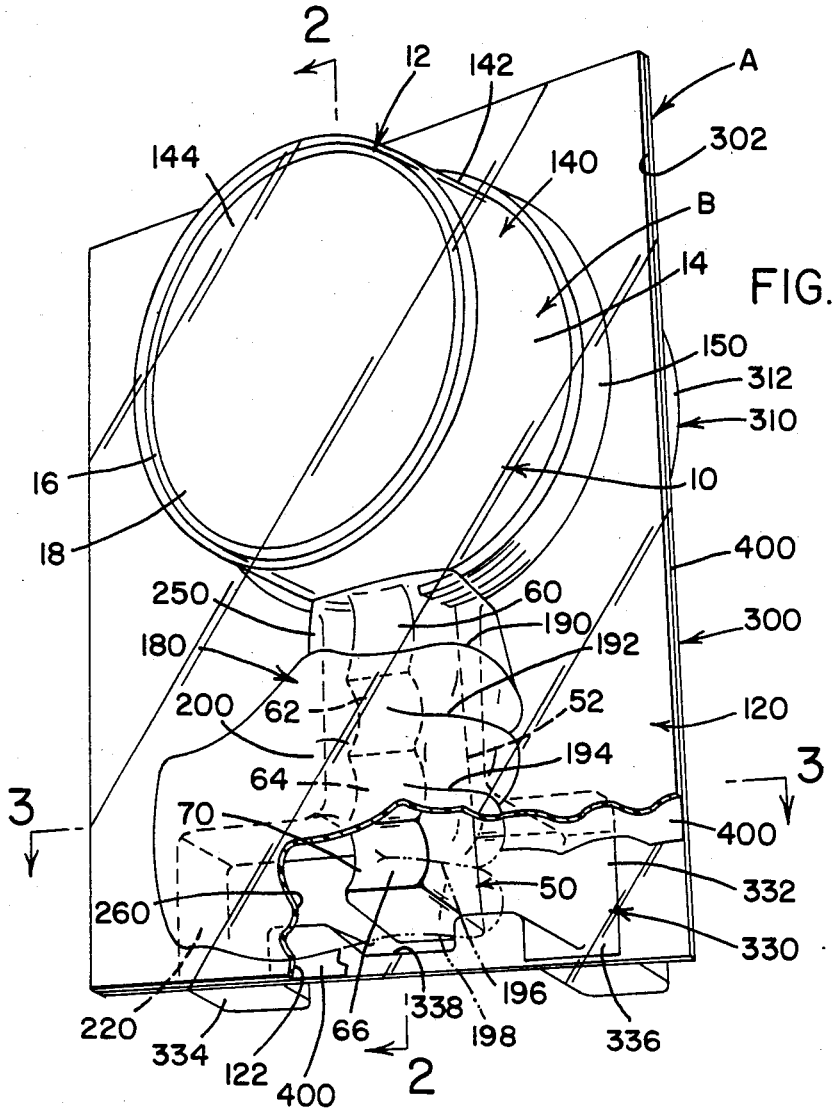
FIG. 1 is a pictorial view showing the preferred embodiment of the present invention with a portion of the second, enlarged cavity in the front display sheet cut away.

Front clear sheet 120 includes a second rigid cavity 180 simulating a human hand extending around girth 52 of handle 50. This cavity is provided with transversely extending ribs 190–196 and a bottom wall 198. The portion between ribs 190–192 and bottom wall 198 are generally curvilinear, as best shown in FIG. 2. These curvilinear cross sections shown in their entirety in FIG. 1 simulate fingers as the right hand portion of the outer surface of second cavity 180. Handle 50 extends through the finger portion of cavity 180, as shown in FIGS. 1 and 2. This second cavity has a hollow left hand portion extending from the transversely extending ribs to define a knuckle simulating portion 200 terminating in a laterally extending hollow wrist portion 220. By combining these various hollow portions to define second cavity 180, this cavity has the appearance of a human hand gripping girth 52 of downwardly extending handle 50. As can be seen, cavity 180 does not match handle 50 in the same fashion that upper cavity 140 matches the forwardly facing portion of housing 10. Consequently, this lower cavity is formed to produce a preselected mechanical shape which is defined in a fashion to simulate a hand gripping the hand-held product in package A. Of course, this shape could be reversed or modified to contain fingers, knuckles and a wrist simulated rigid protrusion on sheet 120.

The outer front display sheet 120 has a third cavity 150 extending between the first and second cavities to provide clearance of the portion of the handle extending from cavity 180 to upper cavity 140. As illustrated best in FIG. 2, the inner surface of cavity 180 is provided with a layer of colored material. In the preferred embodiment, this colored material can be a layer of paint 260 for the color simulating the color of human skin or colors indicative thereof.

As shown in FIG. 2, the flat interface surface 122 of the clear plastic front display sheet 120 lies along plane P. Behind the plane there is provided a clear plastic back cover sheet 300 having a generally flat interface surface 302 secured onto surface 122 for the purpose of holding the back cover and front display sheets together to encapsulate the product B between the plastic formed sheets. The back sheet includes a first cavity 310 having a generally tapered peripheral wall 312 and an outer profile 314 for the purpose of receiving the rear portion of housing 10, as best shown in FIG. 2. An inwardly directed support tab 320 extends inwardly from profile 314 into recess 90, as shown in FIG. 4. This provides a vertical support for housing 10 in package A. The second cavity 330 in the clear plastic back cover 300 does not match the second cavity in the front sheet. In the back sheet, this second cavity, best shown in FIGS. 3 and 5, includes a transversely extending clearance volume 332 for the purpose of storing cord 331, shown partially in FIG. 5. Opposite ends of this transverse clearance volume includes downwardly directed legs 334, 336 to allow the package A to stand on a platform with the product plane P extending vertically upwardly for the purposes of displaying the product to the consumer. Between these support legs or pedestals and from clearance volume 332 there is provided a clearance slot 338 for the purpose of allowing cord 331 to bend from the end of handle 50 and extend into clearance volume 332 for the purposes previously described. If the package is not to be displayed on support legs or pedestals 334, 336, it can be displayed by hanging on a pegboard using hanger slot 350, as shown in FIG. 4.

Figure 3:
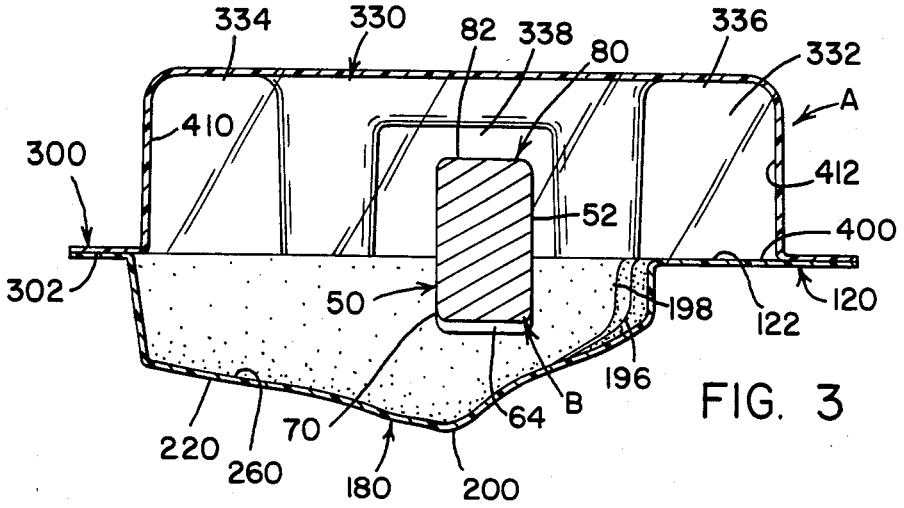
FIG. 3 is a cross sectional view taken generally along line 3—3 of FIG. 1.

Referring now to FIG. 2A, in the preferred embodiment, a sheet of paper or printed informational sheet 400 is provided between the flat interface surfaces of front display sheet 120 and back cover sheet 300. This informational sheet can include printed material on one or both sides for the purposes of advertising. This advertising sheet, in the preferred embodiment, extends only around the flat exposed portions as best shown in FIG. 1. The sheet does extend inwardly of walls 410, 412 of transverse clearance volume 332 as shown in FIG. 3. In other words, the printed material is available on the flat portions of sheet 120, as shown outside cavities 140, 180 and 250 on front plastic sheet 120.

Having thus described the invention, the following is claimed:

1. A self-sustaining package for encapsulating and displaying a hand-held consumer product, said product including an upper housing containing a manually manipulative implement with a front portion facing in a forward direction and a rearwardly facing back portion and a rigid, downwardly depending, generally elongated handle fixed to said upper housing and extending in a direction generally orthogonal with respect to said forward direction, said product having a vertical plane extending in the orthogonal direction of said handle and generally between said front and back portions, said front portion extending from said plane having a maximum peripheral shape in the direction parallel to said plane and a protruding profile extending a given distance outwardly from said plane, and said handle having a girth portion spaced below said housing and having an hand grip for receiving encircling fingers with a portion of said girth portion protruding in a forward direction from said plane, said package comprising: a clear, rigid, plastic front display sheet with a generally flat interface surface lying in said plane of said product, a first forwardly protruding cavity permanently formed in said display sheet with an outer peripheral shape generally matching, but larger than, said maximum peripheral shape of said extending front portion and a profile matching, but outwardly of, said protruding profile, and a second forwardly protruding cavity permanently formed into a selected shape in said display sheet with a form generally matching, but larger than, said protruding portion of said girth portion, said selected shape of said second cavity including a set of undulating ribs extending transversely across said girth portion as simulated fingers gripping said girth portion and a transversely extending hollow portion formed into a simulated hand and part of a simulated wrist extending transversely from said girth portion, and a back cover sheet joined with said display sheet to encapsulate said product.

2. A self-sustaining package as defined in claim 1 wherein said display sheet includes a third cavity extending outwardly from said plane between said first and second cavities to cover said handle of said product between said girth portion and said housing.

3. A self-sustaining package as defined in claim 2 including a layer of generally opaque colored material on the inside of said second cavity.

4. A self-sustaining package as defined in claim 1 including a layer of generally opaque colored material on the inside of said second cavity.

5. A self-sustaining package as defined in claim 4 including means formed by said display sheet and said back cover sheet to support said package in an upright position on a platform.

6. A self-sustaining package as defined in claim 1 including mean formed by said display sheet and said back cover sheet to support said package in an upright position on a platform.

7. A self-sustaining package as defined in claim 5 including an information sheet containing printed material located between said front sheet and said back cover sheet except in the areas of said cavities, with said printed material visible through said plastic display sheet.

8. A self-sustaining package as defined in claim 2 including an information sheet containing printed material located between said front sheet and said back cover sheet except in the areas of said cavities, with said printed material visible through said plastic display sheet.

9. A self-sustaining package as defined in claim 1 including an information sheet containing printed material located between said front sheet and said back cover sheet except in the areas of said cavities, with said printed material visible through said plastic display sheet.

10. A self-sustaining package as defined in claim 9 wherein said back cover sheet is formed from clear plastic and at least part of said printed material is visible through said back cover sheet.

11. A self-sustaining package as defined in claim 1 wherein said back cover sheet includes a flat interface surface abutting said interface surface of said display sheet, a first cavity generally matching said first cavity of said display sheet and a second cavity matching only a portion of said second cavity of said display sheet.

12. A self-sustaining package as defined in claim 1 wherein said back portion of said housing has an inward protruding indentation and said back cover sheet includes a boss extending into said indentation for locating and supporting said product between said display sheet and said back cover sheet.

13. A self-sustaining package for encapsulating and displaying a hand-held consumer product, said product including an upper housing containing a manually manipulative implement with a front portion facing in a forward direction and a rearwardly facing back portion and a rigid, downwardly depending, generally elongated handle fixed to said upper housing and extending in a direction generally orthogonal with respect to said forward direction, said product having a vertical plane extending in the orthogonal direction of said handle and generally between said front and back portions, said front portion extending from said plane having a maximum peripheral shape in the direction parallel to said plane and a protruding profile extending a given distance outwardly from said plane, and said handle having a girth portion spaced below said housing and having a hand grip for receiving encircling fingers with a portion of said girth portion protruding in a forward direction from said plane, said package comprising: a clear, rigid, plastic front display sheet with a generally flat interface surface lying in said plane of said product, a forwardly protruding cavity permanently formed into a selected shape in said display sheet with a form generally matching, but larger than, said protruding portion of said girth portion, said selected shape of said second cavity including a set of undulating ribs extending transversely across said girth portion as simulated fingers gripping said girth portion and a transversely extending hollow portion formed into a simulated hand and part of a simulated wrist extending transversely from said girth portion, and a back cover sheet joined with said display sheet to encapsulate said product.

* * * * *